US009349553B2

(12) United States Patent
Kawamura

(10) Patent No.: US 9,349,553 B2
(45) Date of Patent: May 24, 2016

(54) SLIDE SWITCH

(71) Applicant: Takashi Kawamura, Tokyo (JP)

(72) Inventor: Takashi Kawamura, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 14/226,979

(22) Filed: Mar. 27, 2014

(65) Prior Publication Data

US 2014/0291135 A1 Oct. 2, 2014

(30) Foreign Application Priority Data

Mar. 28, 2013 (JP) ..... 2013-069084
Mar. 11, 2014 (JP) ..... 2014-047623

(51) Int. Cl.
*H01H 15/06* (2006.01)
*H01H 15/04* (2006.01)
*H01H 15/18* (2006.01)

(52) U.S. Cl.
CPC ..... *H01H 15/04* (2013.01); *H01H 15/18* (2013.01)

(58) Field of Classification Search
CPC ..... H01H 1/365; H01H 1/44; H01H 15/02
USPC ..... 200/252, 257, 260, 547–550
See application file for complete search history.

(56) References Cited

U.S. PATENT DOCUMENTS

| | | | | |
|---|---|---|---|---|
| 5,065,276 | A * | 11/1991 | Chou | 361/820 |
| 6,825,430 | B2 * | 11/2004 | Wong et al. | 200/547 |
| 6,841,744 | B1 * | 1/2005 | Kodo et al. | 200/16 C |
| 7,507,926 | B2 * | 3/2009 | Kawamura et al. | 200/548 |
| 7,800,008 | B2 * | 9/2010 | Shi et al. | 200/547 |
| 8,080,757 | B2 * | 12/2011 | Zuo | 200/548 |
| 8,319,135 | B2 * | 11/2012 | Chen et al. | 200/547 |
| 8,598,479 | B2 * | 12/2013 | Quan et al. | 200/293 |
| 2002/0175061 | A1 * | 11/2002 | Shinkawa | 200/252 |
| 2007/0278084 | A1 * | 12/2007 | Kawamura et al. | 200/531 |
| 2010/0072041 | A1 * | 3/2010 | Zuo | 200/17 R |
| 2012/0241295 | A1 * | 9/2012 | Huang | 200/330 |
| 2013/0256104 | A1 * | 10/2013 | Fujita et al. | 200/252 |

FOREIGN PATENT DOCUMENTS

JP 2013-20739 1/2013

* cited by examiner

*Primary Examiner* — Renee Luebke
*Assistant Examiner* — Ahmed Saeed
(74) *Attorney, Agent, or Firm* — Whitham, Curtis, Christofferson & Cook, P.C.

(57) ABSTRACT

A slide switch includes a case forming an accommodation space, a first contact disposed in the accommodation space, a second contact disposed in the accommodation space, a third contact disposed in the accommodation space, and a slider fixed to the third contact. The slider is movable between a first position in which the first contact and the second contact are electrically insulated from each other and a second position in which the first contact and the second contact are electrically connected to each other via the third contact. The case includes a projection supporting the third contact in a normal direction of a plane which includes a moving path of the slider in the accommodation space.

5 Claims, 7 Drawing Sheets

SLIDE SWITCH

BACKGROUND

The present invention relates to a slide switch.

A slide switch includes a case that defines an accommodation space. A first contact and a second contact are disposed inside the accommodation space as fixed contacts. A third contact as a movable contact is fixed to a slider and disposed inside the accommodation space. The slider is movable between a first position in which the first contact and the second contact are electrically insulated from each other and a second position in which the first contact and the second contact are electrically connected to each other via the third contact (refer to Patent Document 1).

[Patent Document 1] JP-A-2013-20739

SUMMARY

It is therefore one advantageous aspect of the present invention to provide a slide switch in which defects such as a conduction failure can be prevented even when the sizes of the parts of the slide switch are reduced.

According to one aspect of the invention a slide switch, comprising:

a case forming an accommodation space;

a first contact disposed in the accommodation space;

a second contact disposed in the accommodation space;

a third contact disposed in the accommodation space; and a slider fixed to the third contact, wherein the slider is movable between a first position in which the first contact and the second contact are electrically insulated from each other and a second position in which the first contact and the second contact are electrically connected to each other via the third contact, and the case includes a projection supporting the third contact in a normal direction of a plane which includes a moving path of the slider in the accommodation space.

The slide switch may be configured such that: the third contact includes a first portion, a second portion, and a third portion; the first portion and the second portion are displaceable in the normal direction; the third portion is disposed between the first portion and the second portion and fixed to the slider; and the projection supports the third portion.

The slide switch may be configured such that: the third portion extends so that a longitudinal direction of the third portion is a movement direction of the slider; the first portion is supported in a cantilever beam form in a first end portion in the longitudinal direction of the third portion; the second portion is supported in a cantilever beam form in a second end portion in the longitudinal direction of the third portion; the first portion extends from the first end portion to the second end portion, in one direction; and the second portion extends from the second end portion to the first end portion, in one direction.

The slide switch may be configured such that: a recess portion recessed in the normal direction is formed on the slider; and the third contact and the projection is disposed in the recess portion.

The slide switch may be configured such that the projection extends across the overall movable range of the slider along a movement direction of the slider.

DETAILED DESCRIPTION OF EXEMPLIFIED EMBODIMENTS

In general, a movable contact is fixed to a slider by crimping or the like. As the size of a switch is required to be reduced, it is inevitable that the sizes of element parts, such as the slider and the movable contact, are reduced. For this reason, a structural strength that is sufficient for the movable contact on the slider cannot be ensured, and there is a case where a positional displacement or a backlash of the movable contact occurs. As a result, defects such as a conduction failure can be caused.

An object of the present invention is to provide a technology that can prevent defects such as a conduction failure, even when the sizes of the parts that configure a structure of a slide switch are reduced.

With reference to the attached drawings, an example of an embodiment according to the invention will be described in detail. In each drawing used for following description, a scale is appropriately changed so as to make the size of each member recognizable. In addition, expressions such as back, forth, right, left, up and down are used for convenience of description, and do not limit postures or directions in actual use conditions.

Figure 1:
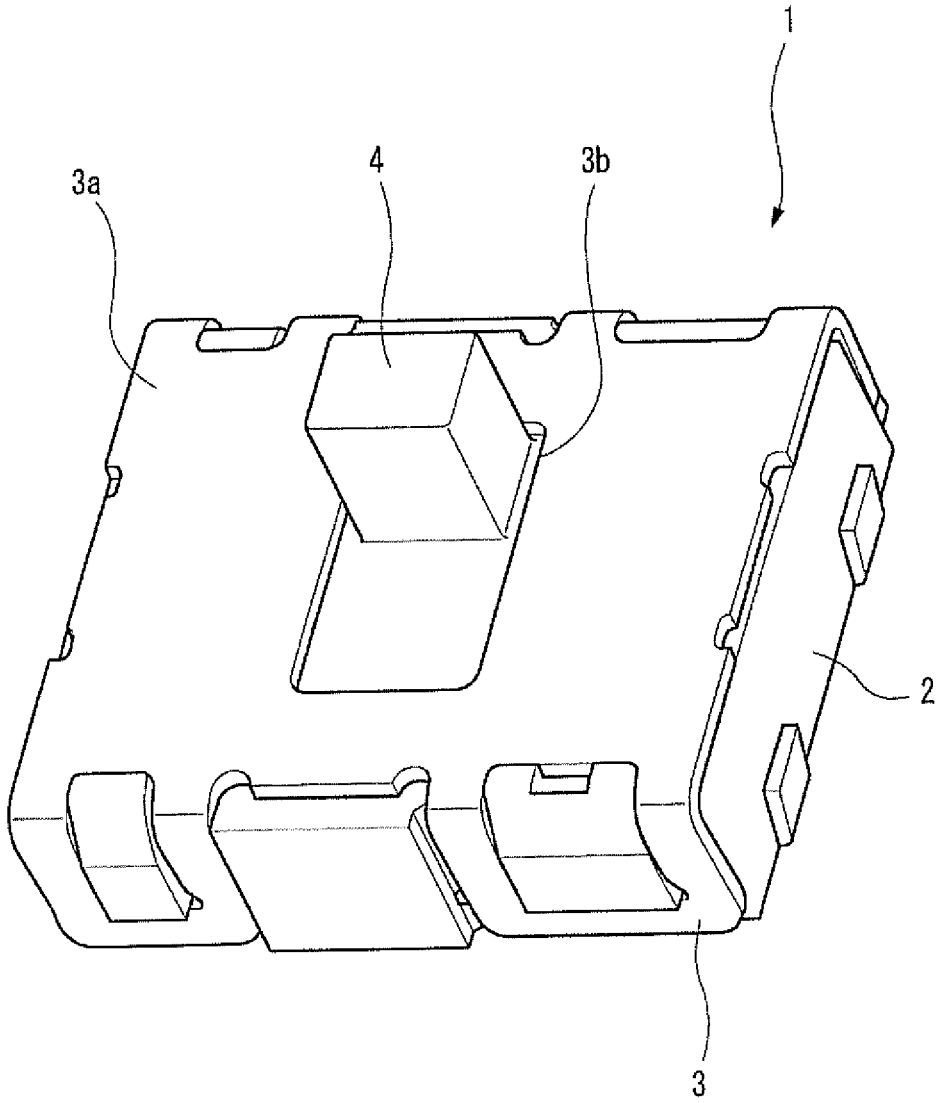
FIG. 1 is a perspective view showing an external appearance of a slide switch according to an embodiment of the invention.

FIG. 1 is a perspective view showing an external appearance of a slide switch 1 according to an embodiment of the invention. The slide switch 1 includes a case 2, a cover 3, and an operation portion 4. The case 2 is formed from an insulating material and configured to be mounted on a circuit substrate. The cover 3 is formed from a conductive material and installed on the case 2. An opening 3*b* is formed to extend in a back-and-forth direction on an upper surface 3*a* of the cover 3. The operation portion 4 is formed from an insulating material and extends in an up-and-down direction through the opening 3*b*.

Figure 2:
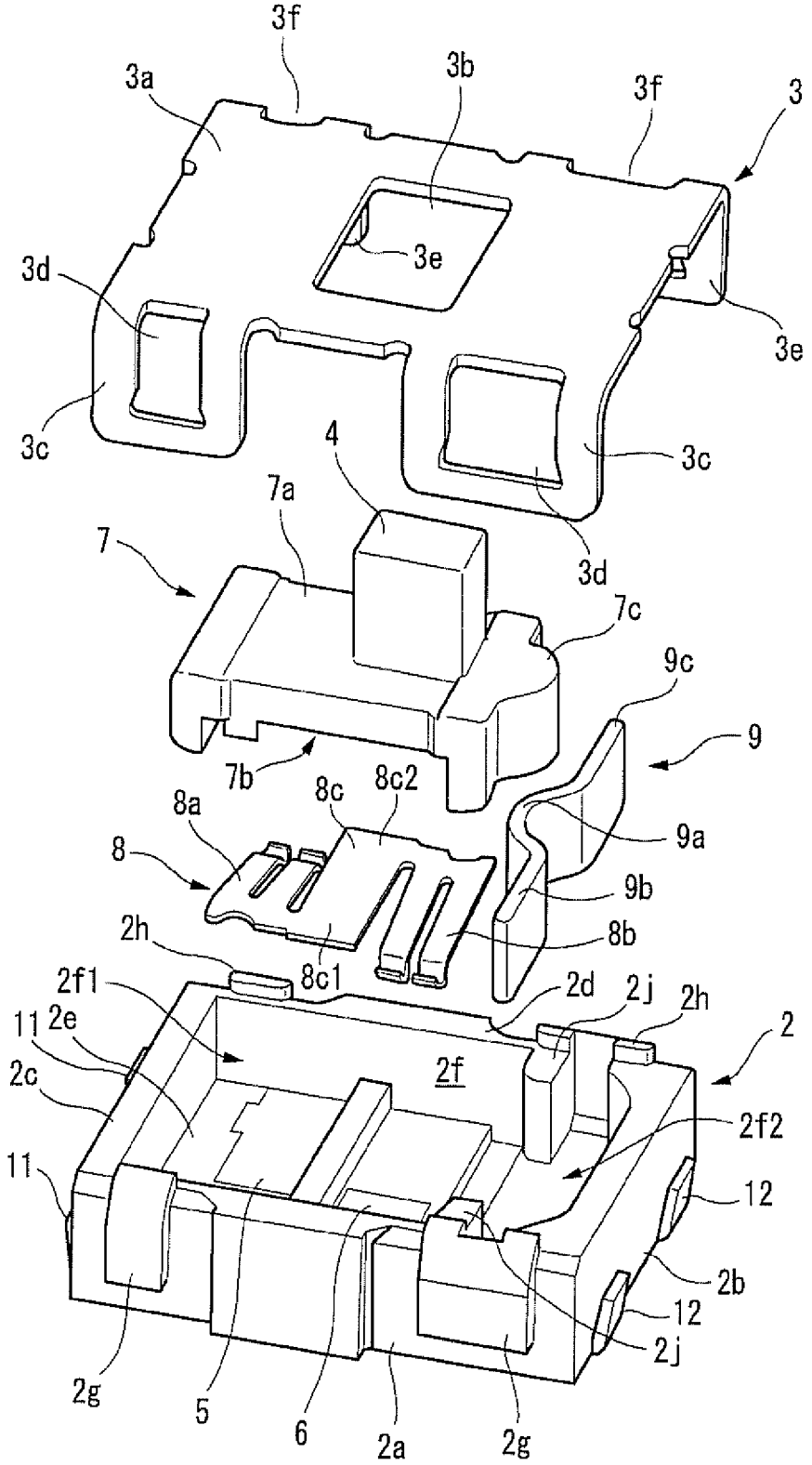
FIG. 2 is an exploded perspective view showing the slide switch.

FIG. 2 is an exploded perspective view showing the slide switch 1. The slide switch 1 includes the case 2, the cover 3, and the operation portion 4, and further includes a first fixed contact 5, a second fixed contact 6, a slider 7, a movable contact 8, a retainer plate 9, a first connection terminal 11, and a second connection terminal 12.

The case 2 includes a front wall 2*a*, a right wall 2*b*, a left wall 2*c*, a rear wall 2*d*, and a bottom wall 2*e*. An accommodation space 2*f* is defined by these walls 2*a* to 2*e*. A plurality of locking projections 2*g* are formed on the front wall 2*a*. A plurality of locking projections 2*h* are formed on the rear wall 2*d*. A division wall 2*j* is formed in the accommodation space 2*f*. The division wall 2*j* divides the accommodation space 2*f* into a first accommodation portion 211 and a second accommodation portion 212.

The first fixed contact 5 (a first contact) is formed from a conductive material. The first fixed contact 5 is disposed on the bottom wall 2*e* close to the rear wall 2*d* in the first accommodation portion 211. The second fixed contact 6 (a second contact) is formed from a conductive material. The second fixed contact 6 is disposed on the bottom wall 2*e* close to the front wall 2*a* in the first accommodation portion 2*f*1.

The first fixed contact 5 is electrically connected with the first connection terminal 11 disposed on an outer side of the left wall 2*c*. The second fixed contact 6 is electrically connected with the second connection terminal 12 disposed on an outer side of the right wall 2*b*. When the slide switch 1 is mounted on the circuit substrate (not shown), the first connection terminal 11 and the second connection terminal 12 are electrically connected with contacts formed on the circuit substrate. Electric connection with the contact is performed by soldering or the like.

The slider 7 is formed from an insulating material. The above-described operation portion 4 is provided on an upper surface 7*a* of the slider 7. A recess portion 7*b* is formed in a lower part of the slider 7. In a right side part of the slider 7, a semicylindrical projection 7*c* is formed.

The movable contact 8 (a third contact) is formed from a conductive material. The movable contact 8 includes a first arm 8*a* (a first portion of the third contact), a second arm 8*b* (a second portion of the third contact), and a base 8*c* (a third portion of the third contact). The base 8*c* is disposed between the first arm 8*a* and the second arm 8*b*.

The first arm 8*a* is supported by a front end portion 8*c*1 (a first end portion of the third portion) of the base 8*c* in a cantilever beam form. The second arm 8*b* is supported by a rear end portion 8*c*2 (a second end portion of the third portion) of the base 8*c* in a cantilever beam form.

Figure 3:
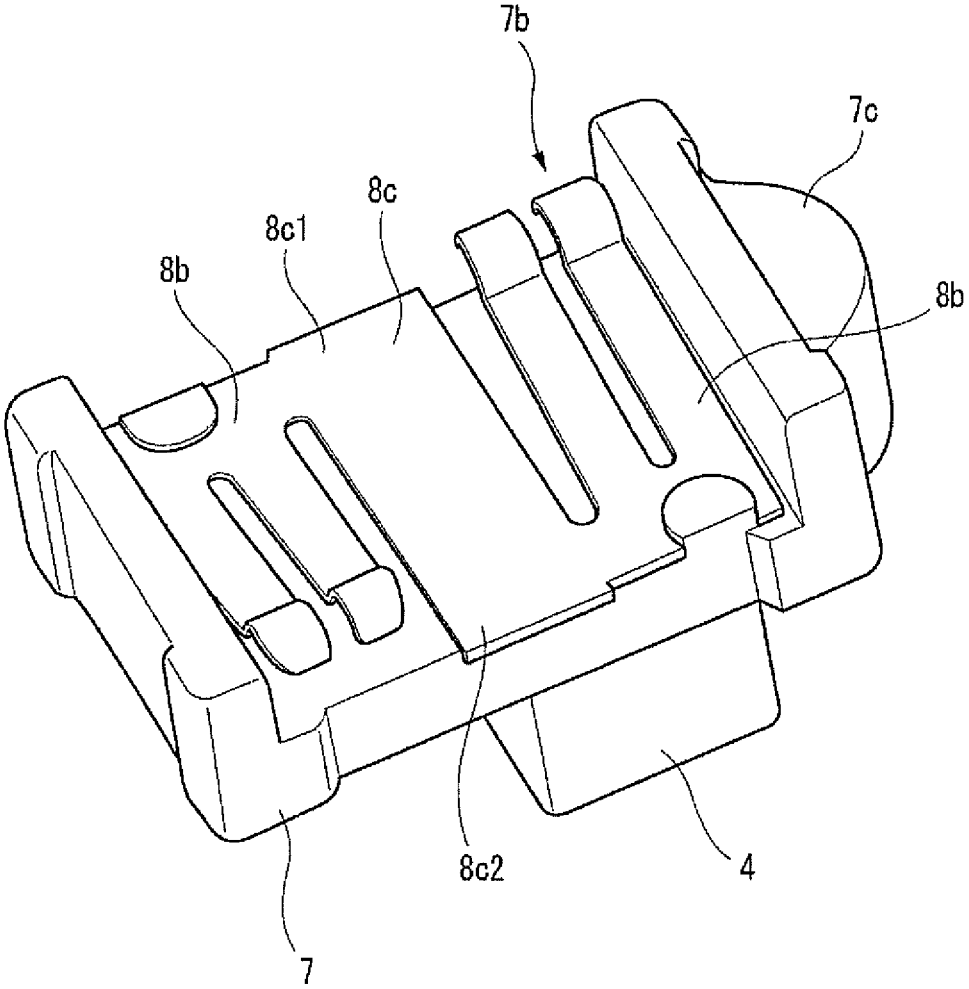
FIG. 3 is a perspective view showing a movable contact fixed to a slider which is included in the slide switch.

As shown in FIG. 3, the movable contact 8 is fixed in the recess portion 7*b* of the slider 7. In the embodiment, crimping is performed in the base end portion of the first arm 8*a* and the second arm 8*b* that are respectively supported by the base 8*c* in a cantilever beam form, accordingly, the base 8*c* is fixed to the slider 7. Meanwhile, a tip end portion of the first arm 8*a* and the second arm 8*b*, respectively, is allowed to be displaced.

The retainer plate 9 is formed from a material having elasticity. As shown in FIG. 2, the retainer plate 9 includes a curved portion 9*a* and flat portions 9*b* and 9*c* which are connected to both sides of the curved portion 9*a*. The retainer plate 9 is fixed in the second accommodation portion 2*f*2 in a posture, in which the flat portions 9*b* and 9*c* extend in the back-and-forth direction, facing a convex side of the curved portion 9*a* toward a side of the first accommodation portion 2*f*1.

Figure 4A:
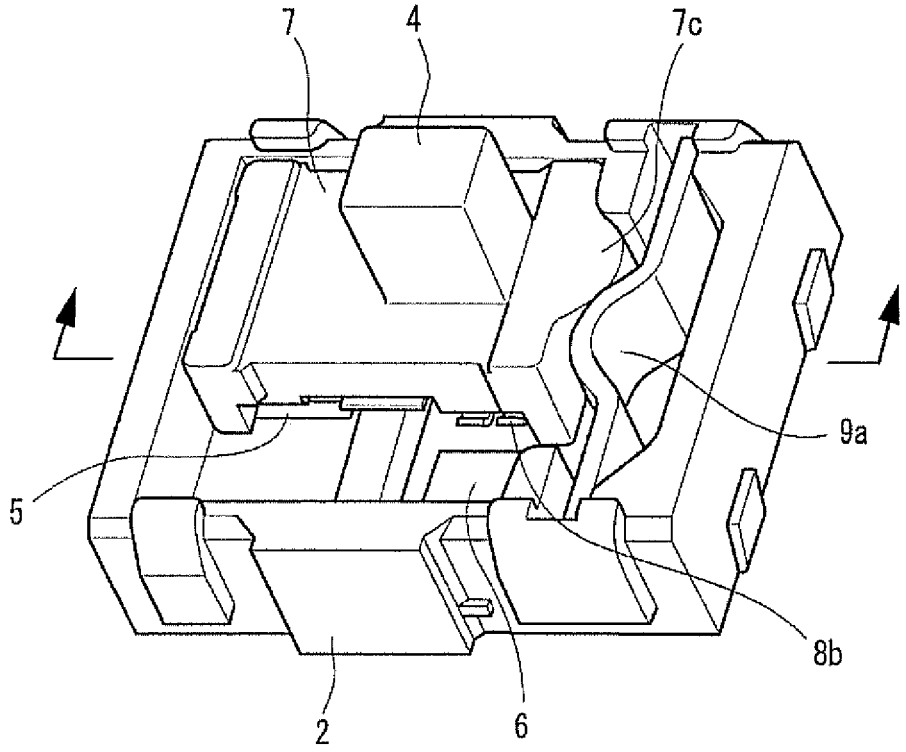
FIGS. 4A and 4B are views illustrating a movement of the slider.

FIG. 4A shows a state where the slider 7 to which the movable contact 8 is fixed and the retainer plate 9 are disposed in the accommodation space 2*f*. In this position, the tip end portion of the first arm 8*a* of the movable contact 8 fixed to the lower part of the slider 7 is contacted with the first fixed contact 5. Meanwhile, the tip end portion of the second arm 8*b* of the movable contact 8 is not contacted with the second fixed contact 6. That is, in a case where the slider 7 is disposed on the position, the first fixed contact 5 and the second fixed contact 6 are electrically insulated (a first position). In this case, the projection 7*c* of the slider 7 abuts against the curved portion 9*a* of the retainer plate 9, and the displacement from the position shown in the drawing is controlled.

Figure 4B:
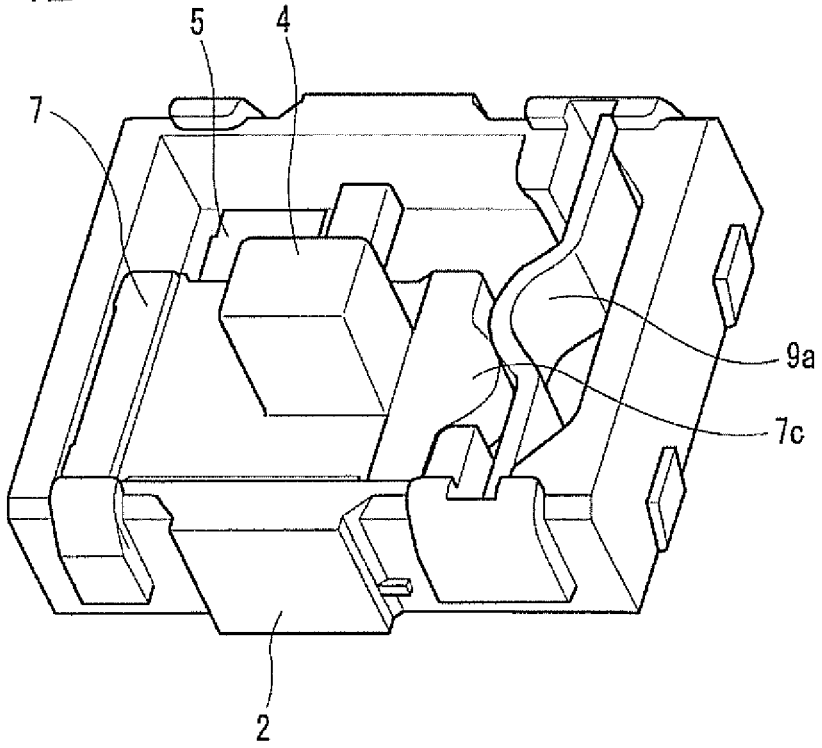

By applying a force which is equal to or higher than a constant value to the operation portion 4 toward the front, the projection 7*c* deforms the retainer plate 9 and moves over the curved portion 9*a*. The slider 7 gives an operator a moderate feeling and moves to the position shown in FIG. 4B. In this case, the tip end portion of the first arm 8*a* of the movable contact 8 is sequentially contacted with the first fixed contact 5. Meanwhile, the tip end portion of the second arm 8*b* of the movable contact 8 is also contacted with the second fixed contact 6. That is, in a case where the slider 7 is disposed on the position, the first fixed contact 5 and the second fixed contact 6 are electrically connected via the movable contact 8 (a second position). The curved portion 9*a* of the retainer plate 9 returned to an original shape abuts against the projection 7*c*, and thus the displacement of the slider 7 from the position is controlled.

As shown FIG. 2, the cover 3 includes a plurality of arms 3*c* extending downward from the front end portion. Locking holes 3*d* are formed on each of the arms 3*c*. The cover 3 further includes a plurality of arms 3*e* extending downward from the rear end portion. Locking holes 3*f* are formed on each of the arms 3*e*. By covering the case 2 with the cover 3 in a state shown in FIGS. 4A and 4B, the locking projections 2*g* and 2*h* of the case 2 are respectively engaged with the locking holes 3*d* and 3*f* of the cover 3. Accordingly, the cover 3 closes the accommodation space 2*f* and is fixed to the case 2. The operation portion 4 can be displaced in the opening 3*b* of the case 3, according to the movement of the slider 7.

Figure 5A:
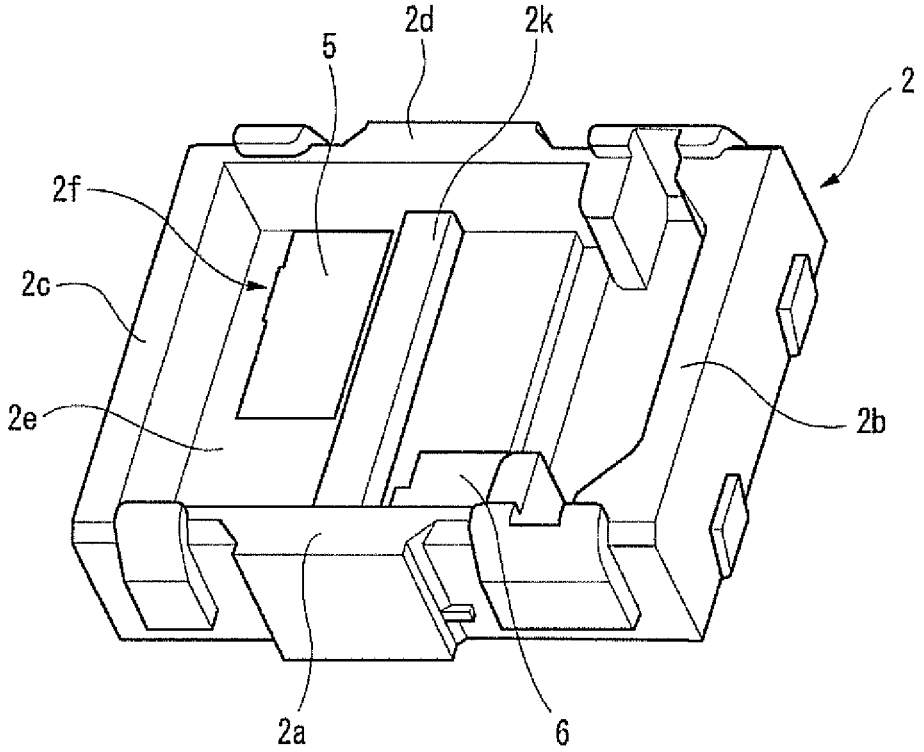
FIGS. 5A and 5B are views illustrating a protrusion that supports the movable contact.

As shown in FIG. 5A, a protrusion 2*k* (a projection) is formed on the bottom wall 2*e* of the case 2. The protrusion 2*k* extends between the first fixed contact 5 and the second fixed contact 6, along the back-and-forth direction, that is, the movement direction of the slider 7.

Figure 5B:
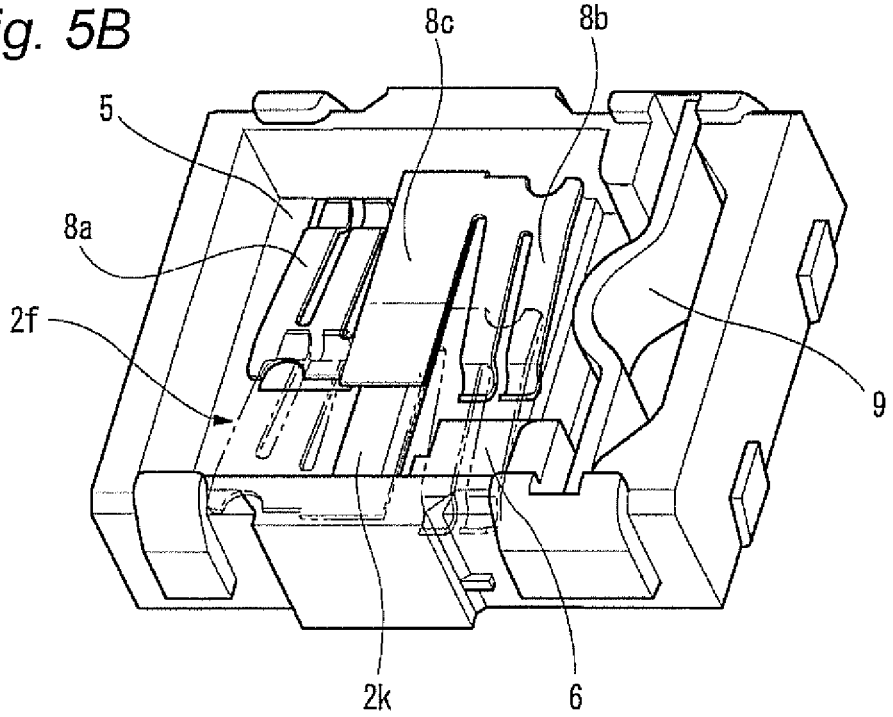
Figure 6:
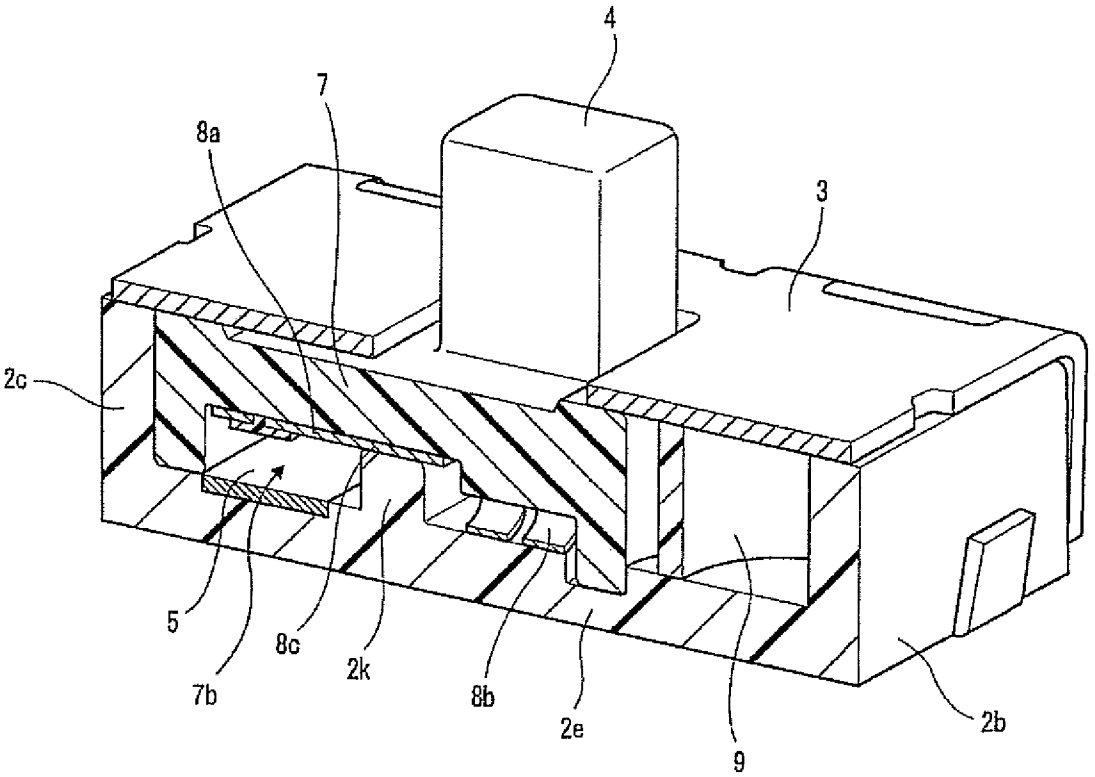
FIG. 6 is a cross-sectional view taken along the line IV-IV in FIG. 4A.

FIG. 5B shows a position relation between the movable contact 8 and the protrusion 2*k* in a state where the slider 7 fixed to the movable contact 8 is disposed in the first accommodation portion 2*f*1. The position shown by the solid line responds to a state where the slider 7 is disposed at the position shown in FIG. 4A. The position shown by the two-dot chain line responds to a state where the slider 7 is disposed at the position shown in FIG. 4B. FIG. 6 shows a cross section taken along the line IV-IV in FIG. 4A.

As clarified by the drawings, the protrusion 2*k* supports the movable contact 8 from below. In other words, the protrusion 2*k* supports the movable contact 8 from a normal direction of a plane including a moving path of the slider 7. Therefore, even in a case where the size of the slide switch 1 is reduced and a structural strength that fixes the movable contact 8 to the slider 7 is not sufficiently ensured, it is possible to retain the movable contact 8 at an original position.

Accordingly, it is possible to prevent a conduction failure caused by a positional displacement and a backlash of the movable contact 8 over a long period of time. In addition, since the position of the movable contact 8 is stabilized, it is possible to stabilize contact resistance between the first fixed contact 5 and the second fixed contact 6. Moreover, it is possible to suppress chattering caused by vibration.

A front end of the protrusion 2*k* is connected with an inner surface of the front wall 2*a* (not shown in the drawing), and a rear end of the protrusion 2*k* is connected with an inner surface of the rear wall 2*d*. That is, the protrusion 2*k* extends across the overall movable range of the slider 7. As a result, regardless of the position of the slider 7, it is possible to support the movable contact 8 at the original position.

More specifically, the protrusion 2*k* supports the base 8*c* of the movable contact 8 fixed to the slider 7. Therefore, it is possible to reliably support the movable contact 8 at the original position, while allowing a displacement of the first arm 8*a* and the second arm 8*b* in the normal direction.

As shown FIGS. 2 and 3, the base 8*c* of the movable contact 8 extends so that a longitudinal direction of the base 8*c* is the movement direction of the slider 7. The first arm 8*a* of the movable contact 8 is supported in the front end portion 8*c*1 of the base 8*c* in a cantilever beam form and extends to the rear end portion 8*c*2 of the base 8*c*, in one direction. The second arm 8*b* of the movable contact 8 is supported in the rear end portion 8*c*2 of the base 8*c* in a cantilever beam form and extends to the front end portion 8*c*1 of the base 8*c*, in one direction.

Here, the expression "extend in one direction" is used in order to distinguish the configuration of the invention from a movable contact configuration described in Patent Document 1 which has a folded part between the base end and the tip end of the arm supported in a cantilever beam form.

According to the movable contact 8 of the embodiment, it is possible to sufficiently ensure flexibility of the first arm 8*a* and the second arm 8*b*, and reduce the dimension of the movable contact in an up-and-down direction (that is, the normal direction of a surface including the movement direction of the slider 7) to be smaller than the dimension of a movable contact described in Patent Document 1. Therefore, the size of the slide switch 1 can be smaller.

As shown in FIG. 6, the recess portion 7*b* of the slider 7 is recessed in the above-described normal direction, and the protrusion 2*k* and the movable contact 8 are disposed in the recess portion 7*b*. Accordingly, it is possible to make the slide switch 1 thin.

The above-described embodiment is used to make understanding the invention easier, and does not limit the invention thereto. The invention can be changed and improved insofar as there is no departure from the scope of the invention, and also can include the invention equivalents.

The number of the fixed contacts disposed in the accommodation space 2*f* of the case 2 is not limited to two. For example, when three fixed contacts A, B, and C are arranged on the moving path of the slider 7 and the three fixed contacts are disposed at a position of the slider 7, the fixed contacts A and B may have a configuration to be conducted via the movable contact. When the slider 7 is disposed at a different position from the three fixed contacts A, B, and C, the fixed contacts B and C may have a configuration to be conducted via the movable contact. It is apparent that the more number of fixed contacts may be provided.

The cover 3 installed on the case 2 does not require to be formed from a conductive material. As long as the arms 3*c* and 3*e* have elasticity, the cover 3 may be formed from an insulating material such as resin or the like.

Figure 7A:
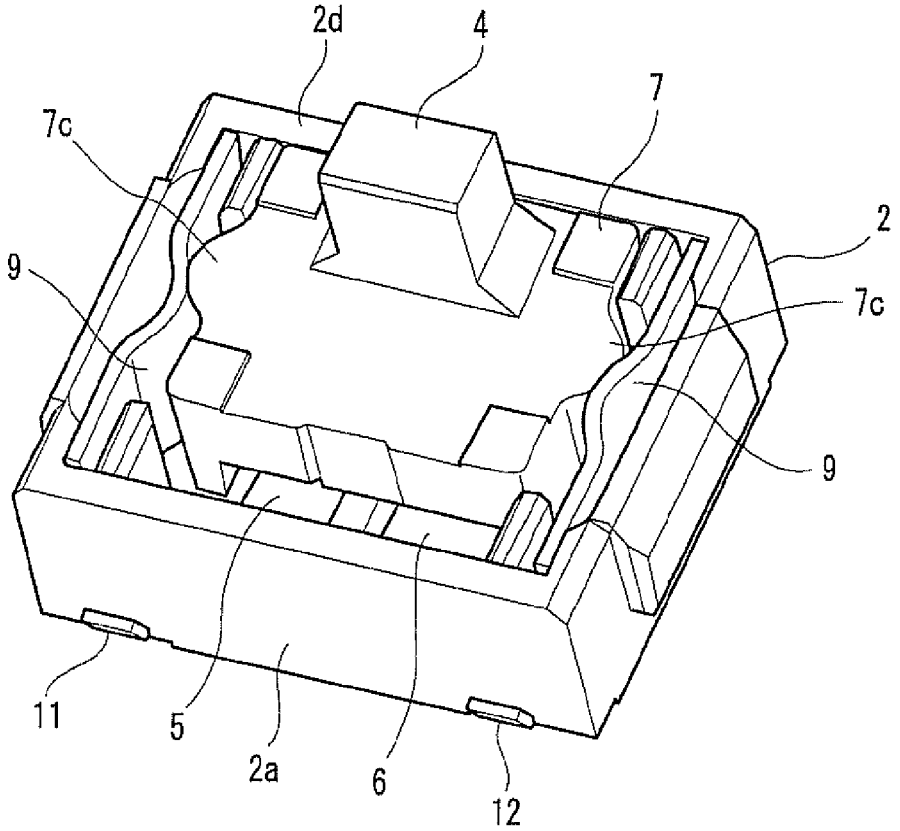
FIGS. 7A and 7B are perspective views showing a part of the slide switch according to a modification example.

The projection 7*c*, similar to the projection 7*c* on the right side portion, may also be formed on the left side portion of the slider 7. The configuration also may have one more retainer plate 9 at a position facing the left side portion of the slider 7. An example of such a configuration is shown in FIG. 7A. In this case, if the load added to the slider 7 is the same, the load applied to each of the retainer plates 9 can be reduced by half. Therefore, it is possible to improve a tolerance to the high load that can be added to the slider 7 through the operation portion 4, and extend the longevity of products.

In addition, the shape and the placement of the first fixed contact 5, the second fixed contact 6, the movable contact 8, the first connection terminal 11, and the second connection terminal 12 can be appropriately changed according to the specification of the switch.

Figure 7B:
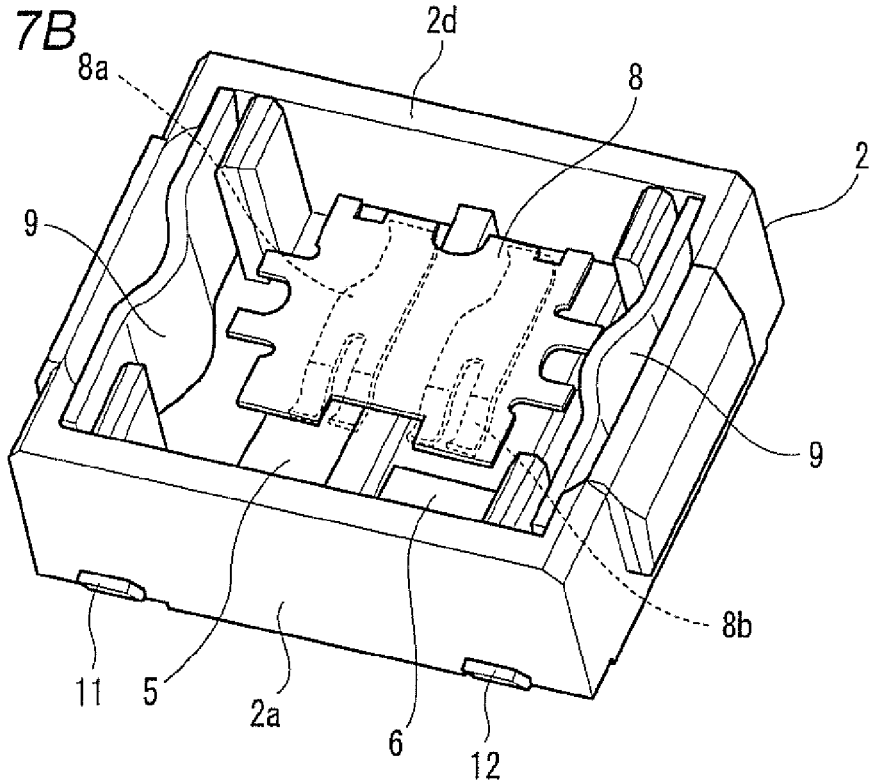

For example, as shown in FIG. 7B, in the modification example of the invention, both the first fixed contact 5 and the second fixed contact 6 are disposed close to the front wall 2*a* of the case 2. The rear end portion of the first fixed contact 5 is disposed closer to the rear wall 2*d* of the case 2 than the rear end portion of the second fixed contact 6. Meanwhile, both the first arm 8*a* and the second arm 8*b* of the movable contact 8 according to the modification example of the invention are supported in the rear end portion side of the movable contact 8 in a cantilever beam form, and extend to the front end portion.

Therefore, in a case where the slider 7 is disposed at a position shown in FIG. 7A, only the first arm 8*a* contacts with the first fixed contact 5, and the first fixed contact 5 and the second fixed contact 6 are electrically insulated (a first position). When the slider 7 moves toward the front wall 2*a*, the second arm 8*b* comes into contact with the second fixed contact 6. As a result, the first fixed contact 5 and the second fixed contact 6 are electrically connected via the movable contact 8 (a second position).

The first connection terminal 11 is disposed on the outer side of the front wall 2*a* and electrically connected with the first fixed contact 5. Not shown in drawings, but the similar first connection terminal 11 is also disposed on the outer side of the rear wall 2*d*. The second connection terminal 12 is disposed on the outer side of the front wall 2*a* and electrically connected with the second fixed contact 6. Not shown in drawings, but the similar second connection terminal 12 is also disposed on the outer side of the rear wall 2*d*.

The projection 7*c* of the slider 7 does not require to be formed in a semicylindrical shape. As long as the position of the slider 7 is restricted by the retainer plate 9 and the retainer plate 9 can be changed according to the displacement of the slider 7, the projection 7*c* can be made in an appropriate shape, such as a hemisphere or the like.

The base 8*a* of the movable contact 8 does not require to be fixed to the slider 7 by crimping. Only when the displacement of the movable contact 8 with respect to the slider 7 is prevented, it is possible to employ an appropriate fixing method, such as pressing or the like.

In the invention, even in a case where the size of the slide switch is reduced and the structural strength that fixes the third contact to the slider is not sufficiently ensured, it is possible to support the third contact at an original position. Accordingly, it is possible to prevent a conduction failure that causes a positional displacement or a backlash of the third contact. Since the position of the third contact is stabilized, it is possible to stabilize contact resistance between the first contact and the second contact. It is also possible to suppress chattering caused by vibration.

In the invention, it is possible to reliably retain the third contact at the original position, while allowing a displacement of the first portion and the second portion to the above-described normal direction.

In the invention, it is possible to reduce the dimension of the third contact in the normal direction, while sufficiently ensuring flexibility of the first portion and the second portion. Therefore, such a configuration contributes to the reduction in size of the slide switch.

In the invention, it is possible to reduce the dimension of the slide switch in the normal direction. That is, it is possible to make the slide switch thin.

In the invention, regardless of the position of the slider, it is possible to retain the third contact at the original position.

According to the invention, it is possible to prevent defects such as a conduction failure, even when the sizes of parts that configure the slide switch are reduced.

What is claimed is:

1. A slide switch, comprising:

a case forming an accommodation space;

a first contact disposed in the accommodation space;

a second contact disposed in the accommodation space;

a third contact disposed in the accommodation space; and a slider fixed to the third contact, wherein the slider is movable between a first position in which the first contact and the second contact are electrically insulated from each other and a second position in which the first contact and the second contact are electrically connected to each other via the third contact, the case includes a projection supporting the third contact in a normal direction of a plane which includes a moving path of the slider in the accommodation space, the third contact includes a first portion, a second portion, and a third portion, the first portion and the second portion are displaceable in the normal direction of a plane which includes a moving path of the slider in the accommodation space, and the projection in the case restricts a movement of the third portion of the third contact in the normal direction.

2. The slide switch according to claim 1, wherein the third portion is disposed between the first portion and the second portion and fixed to the slider, and the projection supports the third portion.

3. The slide switch according to claim 2, wherein the third portion extends so that a longitudinal direction of the third portion is a movement direction of the slider, the first portion is supported in a cantilever beam form in a first end portion in the longitudinal direction of the third portion, the second portion is supported in a cantilever beam form in a second end portion in the longitudinal direction of the third portion, the first portion extends from the first end portion to the second end portion, in one direction, and the second portion extends from the second end portion to the first end portion, in one direction.

4. The slide switch according to claim 1, wherein a recess portion recessed in the normal direction is formed on the slider, and the third contact and the projection is disposed in the recess portion.

5. The slide switch according to claim 1, wherein the projection extends across the overall movable range of the slider along a movement direction of the slider.

* * * * *